US008602009B2

(12) United States Patent
Park et al.

(10) Patent No.: US 8,602,009 B2
(45) Date of Patent: Dec. 10, 2013

(54) CHAMBER STRUCTURE FOR VEHICLE

(75) Inventors: Jung Joo Park, Gunpo-si (KR); Ho Sik Lee, Seoul (KR); Young Bok Kim, Hwaseong-si (KR); Yong Il Kang, Siheung-si (KR)

(73) Assignees: Hyundai Motor Company, Seoul (KR); Kia Motors Corporation, Seoul (KR); Kefico Corporation, Gunpo-Si (KR)

( * ) Notice: Subject to any disclaimer, the term of this patent is extended or adjusted under 35 U.S.C. 154(b) by 0 days.

(21) Appl. No.: 13/471,308

(22) Filed: May 14, 2012

(65) Prior Publication Data

US 2013/0152881 A1 Jun. 20, 2013

(30) Foreign Application Priority Data

Dec. 14, 2011 (KR) ..... 10-2011-0134910

(51) Int. Cl.

| | |
|---|---|
| ***F01P 9/00*** | (2006.01) |
| ***F01M 13/00*** | (2006.01) |
| ***F01P 5/10*** | (2006.01) |
| ***F02B 25/06*** | (2006.01) |

(52) U.S. Cl.
USPC ..... 123/573; 123/41.86; 123/572; 123/41.01; 123/41.44

(58) Field of Classification Search
USPC ..... 123/41.86, 572, 573, 574, 41.01, 41.44
See application file for complete search history.

(56) References Cited

U.S. PATENT DOCUMENTS

| | | | | |
|---|---|---|---|---|
| 1,644,719 | A * | 10/1927 | Fliedner | 123/41.67 |
| 2,925,071 | A * | 2/1960 | Keinath | 123/41.86 |
| 4,768,493 | A * | 9/1988 | Ohtaka et al. | 123/573 |
| 4,920,930 | A * | 5/1990 | Sakano et al. | 123/41.86 |
| 6,412,479 | B1 * | 7/2002 | Canfield et al. | 123/573 |
| 8,127,749 | B2 * | 3/2012 | Larsson et al. | 123/572 |
| 8,210,135 | B2 * | 7/2012 | Slaughter et al. | 123/41.86 |
| 2009/0126670 | A1 * | 5/2009 | Kado et al. | 123/184.21 |
| 2009/0241921 | A1 * | 10/2009 | Ito et al. | 123/573 |

FOREIGN PATENT DOCUMENTS

| | | | |
|---|---|---|---|
| JP | 7-166835 | A | 6/1995 |
| KR | 2003-0021459 | A | 3/2003 |
| KR | 2003-0039470 | A | 5/2003 |
| KR | 10-2005-0029470 | A | 3/2005 |
| KR | 10-2006-0013864 | A | 2/2006 |
| KR | 10-2008-0019437 | A | 3/2008 |
| KR | 10-2010-0064569 | A | 6/2010 |

* cited by examiner

*Primary Examiner* — Thanh Truong
*Assistant Examiner* — Tea Holbrook
(74) *Attorney, Agent, or Firm* — Morgan, Lewis & Bockius LLP

(57) ABSTRACT

A chamber structure for a vehicle may include a housing, a chamber formed inside the housing and into which a blow-by gas flows, and a cooling water path which may be formed inside the housing around the chamber and through which a preheated cooling water passes.

4 Claims, 2 Drawing Sheets

CHAMBER STRUCTURE FOR VEHICLE

CROSS-REFERENCE TO RELATED APPLICATION

The present application claims priority to Korean Patent Application No. 10-2011-0134910, filed on Dec. 14, 2011 in the Korean Intellectual Property Office, the entire contents of which is incorporated herein for all purposes by this reference.

BACKGROUND OF THE INVENTION

1. Field of the Invention

The present invention relates to a chamber structure for a vehicle, and more particularly, to a chamber structure for a vehicle, which can prevent freezing through improvement of the chamber structure.

2. Description of Related Art

In general, a blow-by gas means a gas that is exhausted from a combustion chamber to a crank case through a gap between a cylinder and a piston during the compression stroke and the explosion stroke.

The blow-by gas, having been exhausted from the combustion chamber to the crank case, passes through a cylinder block, an exhaust path of a cylinder head, and a head cover, and then flows into a chamber.

However, due to a difference in temperature between the blow-by gas that flows into the chamber and an outside air having a temperature of, for example, about −35° C., freezing occurs on an inner wall of the chamber, and this causes the engine performance to be decreased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a chamber structure for a vehicle, which can keep an internal temperature of a chamber at ambient temperature through cooling water and thus prevent the occurrence of freezing in the chamber through making a cooling water inflow path pass through the inside of the chamber.

In an aspect of the present invention, a chamber structure for a vehicle may include a housing, a chamber formed inside the housing and into which a blow-by gas flows, and a cooling water path which is formed inside the housing around the chamber and through which a preheated cooling water passes.

The cooling water path may have an inlet port coupled to a cooling water inlet hose and an outlet port coupled to a cooling water outlet hose, and the inside of the chamber is kept at ambient temperature through the preheated cooling water that passes through the cooling water path provided inside the housing and adjacent to the chamber.

The cooling water path is formed to extend along an outer wall of the chamber in the housing.

The cooling water path is integrally formed with the housing when the chamber is formed.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
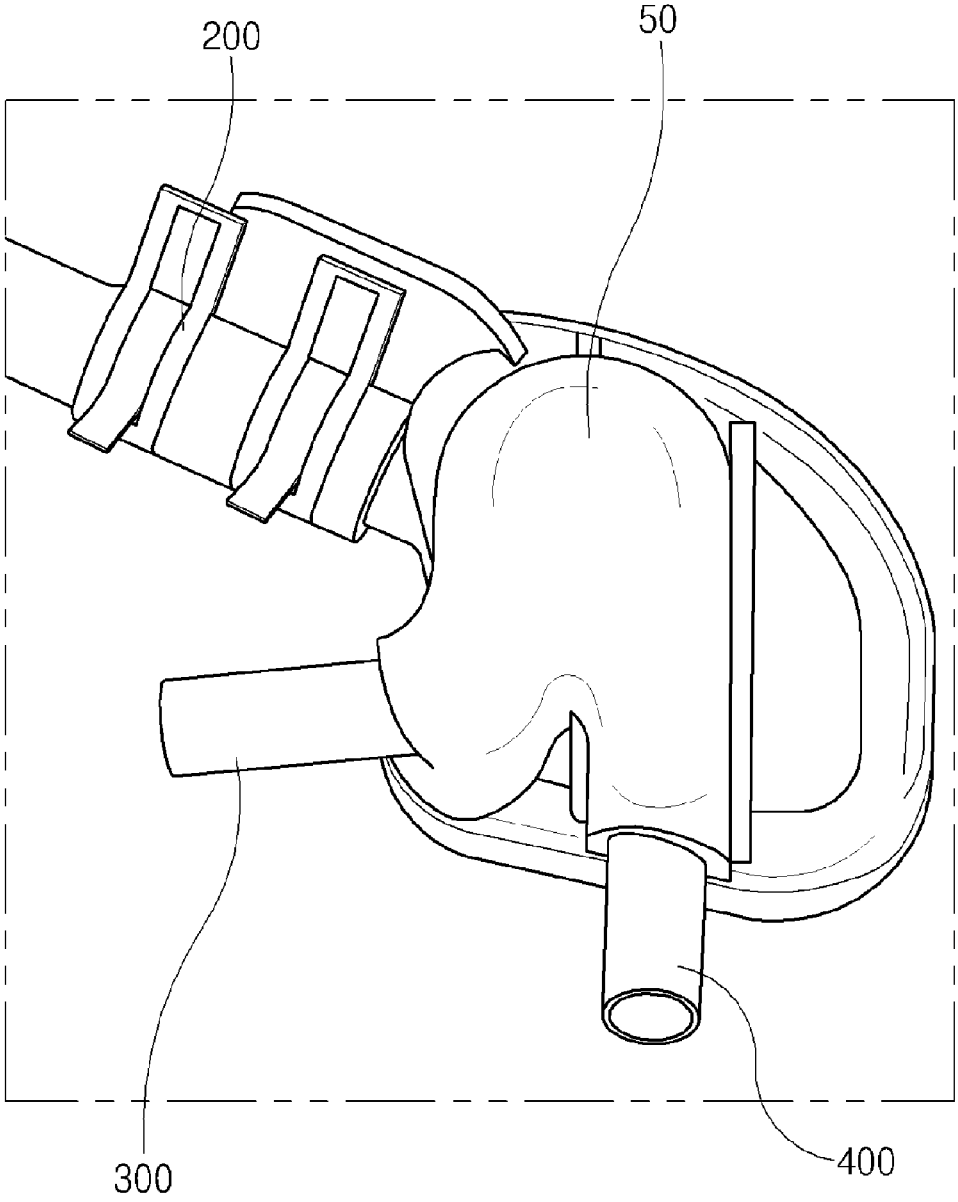
FIG. 1 is a perspective view illustrating a chamber structure according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A chamber structure for a vehicle having the above-described object and effects according to an exemplary embodiment of the present invention may include a chamber into which a blow-by gas flows, and a cooling water path which is formed inside the chamber and through which cooling water passes. The cooling water path has an inlet port coupled to a cooling water inlet hose and an outlet port coupled to a cooling water outlet hose, and the inside of the chamber is kept at ambient temperature through the cooling water that passes through the cooling water path provided inside the chamber.

The cooling water path may be formed to extend along an inner wall of the chamber.

The cooling water path may be integrally formed with the chamber when the chamber is formed.

Hereinafter, a exemplary embodiment of the present invention will be described with reference to the accompanying drawing. The matters defined in the description, such as the detailed construction and elements, are nothing but specific details provided to assist those of ordinary skill in the art in a comprehensive understanding of the invention, and thus the present invention is not limited thereto. In the drawings, portions that do not relate to the description of the present invention are omitted. In the entire description of the present invention, the similar drawing reference numerals are used for the similar elements across various figures.

The chamber structure for a vehicle according to an exemplary embodiment of the present invention can keep an internal temperature of a chamber at ambient temperature using cooling water and thus prevent the occurrence of freezing in the chamber even if a blow-by gas flows into the chamber.

Figure 2:
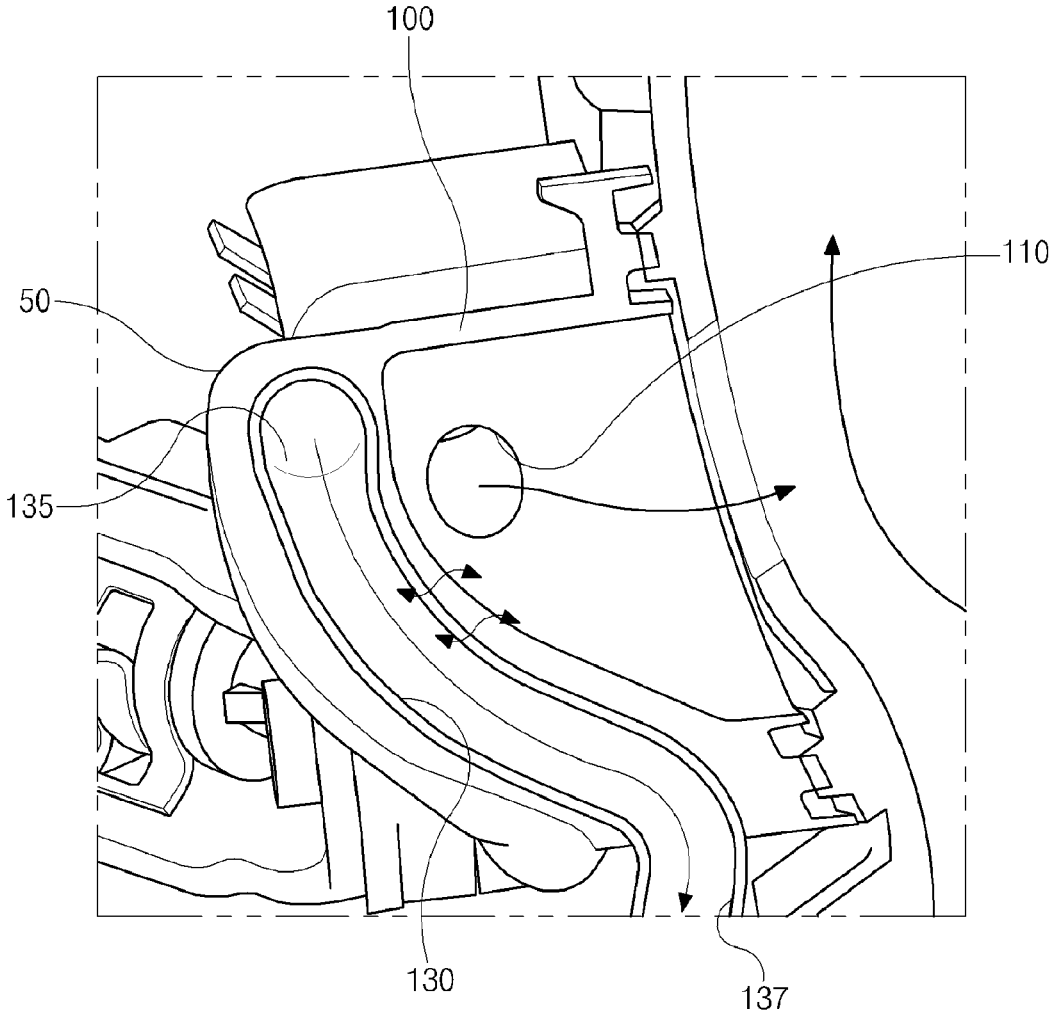
FIG. 2 is a cross-sectional view illustrating a chamber structure according to an exemplary embodiment of the present invention.

As illustrated in FIGS. 1 and 2, the chamber structure for a vehicle according to an exemplary embodiment of the present invention includes a housing 50 coupled to a head cover, a chamber 100 formed inside the housing 50, and a blow-by gas inlet hose 200 coupled to a blow-by gas inlet port 110 to make a blow-by gas flow into the chamber 100. In the chamber 100, a cooling water path 130, through which cooling water having a temperature of for example, about 80° C. passes, is formed. A cooling water inlet hose 300 is coupled to an inlet port 135 of the cooling water path 130, and a cooling water outlet hose 400 is coupled to an outlet port 137 of the cooling water path 130.

That is, as the cooling water of about 80° C. passes through the cooling water path 130 formed inside the chamber 100, the internal temperature of the chamber 100 is increased and kept at the ambient temperature due to the temperature of the cooling water, regardless of the outside air of the head cover.

As described above, according to the chamber structure for a vehicle according to an exemplary embodiment of the present invention, the cooling water passes through the inside of the chamber 100, and thus the occurrence of freezing in the chamber can be prevented.

Although preferred embodiments of the present invention have been described for illustrative purposes, those skilled in the art will appreciate that various modifications, additions and substitutions are possible, without departing from the scope and spirit of the invention as disclosed in the accompanying claims.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A chamber structure for a vehicle, comprising:

a housing coupled to a head cover of an engine;

a chamber formed inside the housing and into which a blow-by gas flows;

a cooling water path which is formed inside the housing around the chamber and through which a preheated cooling water passes;

wherein the cooling water path extends along an outer wall of the chamber in the housing; and wherein the cooling water path is integrally formed with the chamber when the chamber is formed.

2. The chamber structure for the vehicle according to claim 1, wherein the cooling water path has an inlet port coupled to a cooling water inlet hose and an outlet port coupled to a cooling water outlet hose, and the inside of the chamber is kept at ambient temperature through the preheated cooling water that passes through the cooling water path provided inside the housing and adjacent to the chamber.

3. The chamber structure for the vehicle according to claim 2, wherein the chamber includes a blow-by gas inlet port, and wherein the chamber, the blow-by gas inlet port, the cooling water path, and the inlet and outlet ports of the cooling water path are monolithically formed.

4. The chamber structure for the vehicle according to claim 1, wherein the cooling water path and the chamber are monolithically formed.

* * * * *